United States Patent [19]

Satomi

[11] Patent Number: 5,048,765

[45] Date of Patent: Sep. 17, 1991

[54] PAPER MATERIAL REFINING APPARATUS

[75] Inventor: Hitoshi Satomi, Shizuoka, Japan

[73] Assignee: Satomi Seisakusho Co., Ltd., Shizuoka, Japan

[21] Appl. No.: 575,814

[22] Filed: Aug. 31, 1990

[30] Foreign Application Priority Data

Dec. 8, 1989 [JP] Japan ..... 1-142305[U]

[51] Int. Cl.[5] ..... B02C 23/24

[52] U.S. Cl. ..... 241/62; 241/74; 241/79.1; 241/277

[58] Field of Search ..... 241/62, 74, 79, 79.1, 241/277

[56] References Cited

U.S. PATENT DOCUMENTS

| | | | |
|---|---|---|---|
| 2,641,971 | 6/1953 | Ellis | 241/74 |
| 3,307,791 | 3/1967 | Nagai | 241/74 |
| 3,375,776 | 4/1968 | Dyson | 241/74 X |
| 3,474,972 | 10/1969 | Kobayashi | 241/74 X |
| 3,489,356 | 1/1970 | Combs et al. | 241/74 |
| 4,154,407 | 5/1979 | Lamort | 241/79 X |
| 4,615,492 | 10/1986 | Downie | 241/277 X |
| 4,913,359 | 4/1990 | Satomi . | |

FOREIGN PATENT DOCUMENTS

| | | | |
|---|---|---|---|
| 1-250487 | 10/1989 | Japan . | |
| 180744 | 9/1962 | Sweden | 241/74 |
| 156264 | 11/1962 | U.S.S.R. | 241/74 |

*Primary Examiner*—Mark Rosenbaum
*Assistant Examiner*—Frances Chin
*Attorney, Agent, or Firm*—Kanesaka and Takeuchi

[57] ABSTRACT

A paper material refining apparatus has a tank the space in which is divided by a drum-type screen plate into a primary chamber and a secondary chamber, and a material supply pipe for supplying the paper material and a drum-shaped rotor for rotating the material are disposed in the primary chamber. The drum-type rotor is disposed such that its peripheral surface opposes the drum-type screen plate, with the top plate thereof facing the open end of the material supply pipe. The drum-type rotor is provided with step-like projections on the outer peripheral surface thereof. Foreign matters contained in the paper material such as metal pieces are struck by the top plate of the rotor and displaced radially outward by the centrifugal force. The projections formed on the peripheral surface of the drum-type rotor substantially uniformly act on the paper material so as to develop a substantially uniform discharge pressure on the paper material, thus preventing generation of pulsation which is inevitably generated in the conventional apparatus.

10 Claims, 2 Drawing Sheets

PAPER MATERIAL REFINING APPARATUS

BACKGROUND OF THE INVENTION

1. Field of the Invention

The present invention relates to a paper material refining apparatus used in, for example, paper making and pulp industries. More particularly, the present invention is concerned with a paper material refining apparatus having a drum-type screen plate and a drum-type rotor.

2. Description of the Related Art

FIG. 3 shows a known paper material refining apparatus of a type in which a paper material is refined by being passed through a flat screen plate. This type of paper material refining apparatus is disclosed, for example, in Japanese Patent Laid-Open Publication No. 1-250487 and the specification of U.S. Pat. No. 4,913,359.

In the conventional paper material refining device, the paper material is supplied through a material supply pipe 5. The material supplied through the material supply pipe 5 often contains foreign matters such as metal pieces. It is often experienced that the foreign matters such as metal pieces are jammed between a flat screen plate 2' and an impeller 8' of the refining apparatus, with the result that the flat screen plate 2' and the impeller 8' are broken.

SUMMARY OF THE INVENTION

Accordingly, an object of the present invention is to provide a paper material refining apparatus having a drum-type screen plate and a drum-type rotor, wherein the apparatus is improved to prevent damaging of the screen plate and the rotor.

Another object of the present invention is to provide a paper material refining apparatus which is improved to eliminate any pulsation.

To these ends, according to one aspect of the present invention, there is provided a paper material refining apparatus comprising: a tank; a drum-type screen plate which divides the space inside the drum into a primary chamber and a secondary chamber; a material supply pipe for supplying paper making material into the primary chamber; and a drum-type rotor for rotating the material and provided with a top plate; the drum-type rotor being disposed such that the outer peripheral surface thereof opposes the drum-type screen plate with the top plate facing the open end of the material supply pipe.

DESCRIPTION OF THE PREFERRED EMBODIMENT

An embodiment of the paper material refining apparatus of the present invention will be described with reference to the accompanying drawings.

Figure 1:
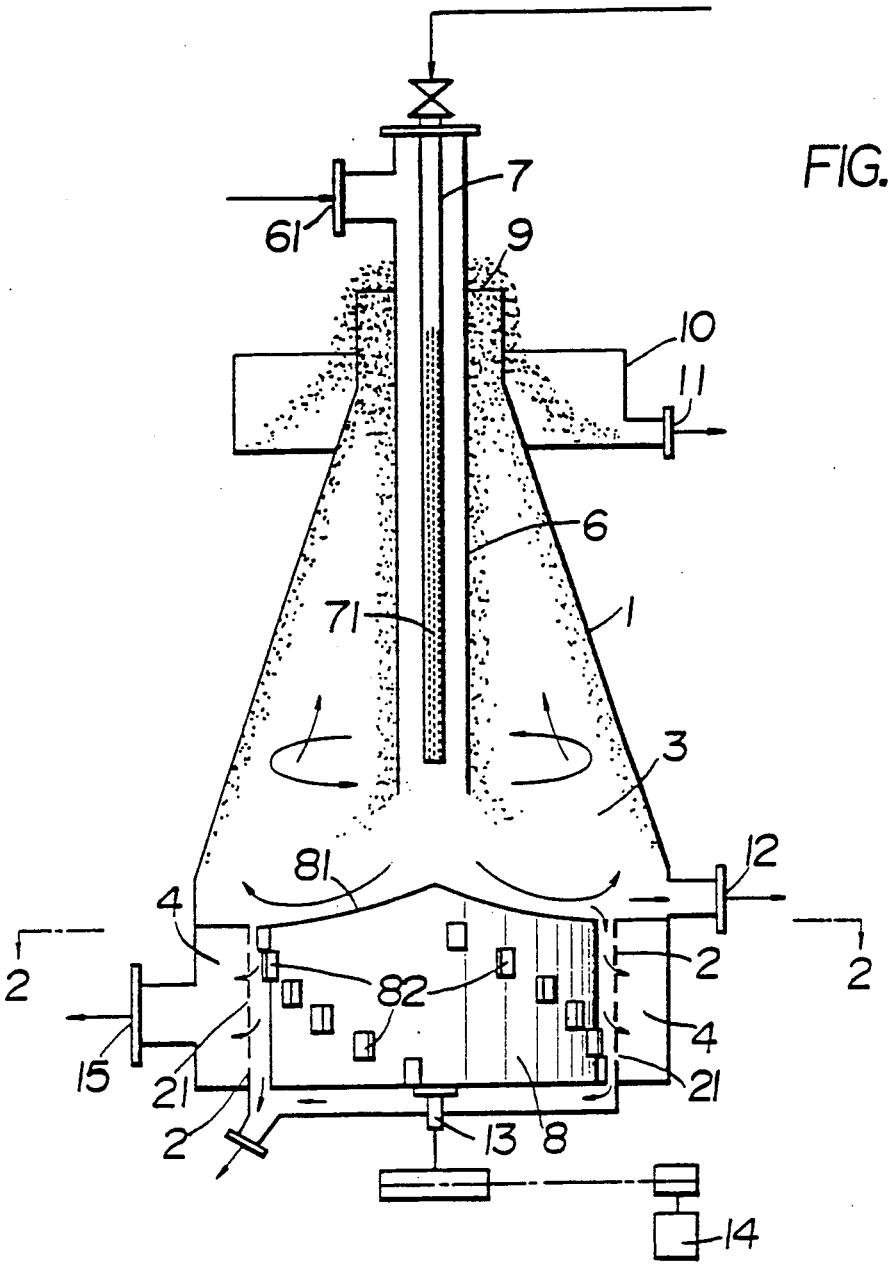
FIG. 1 is a schematic vertical sectional view of an embodiment of the paper material refining apparatus of the present invention.
Figure 2:
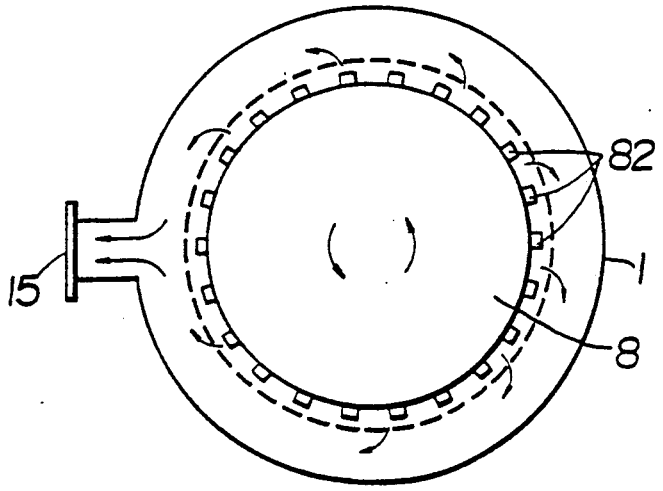
FIG. 2 is a sectional view taken along the line 2—2 of FIG. 1.

Referring to FIG. 1, the paper material refining apparatus embodying the present invention has a tank 1 having a substantially conical form converging toward an upper end when viewed in a vertical section.

The space inside the tank 1 is divided by a screen plate 2 into a primary chamber 3 and a secondary chamber 4.

The drum-type screen plate 2 has a drum-like form with small holes 21 or slits.

Figure 3:
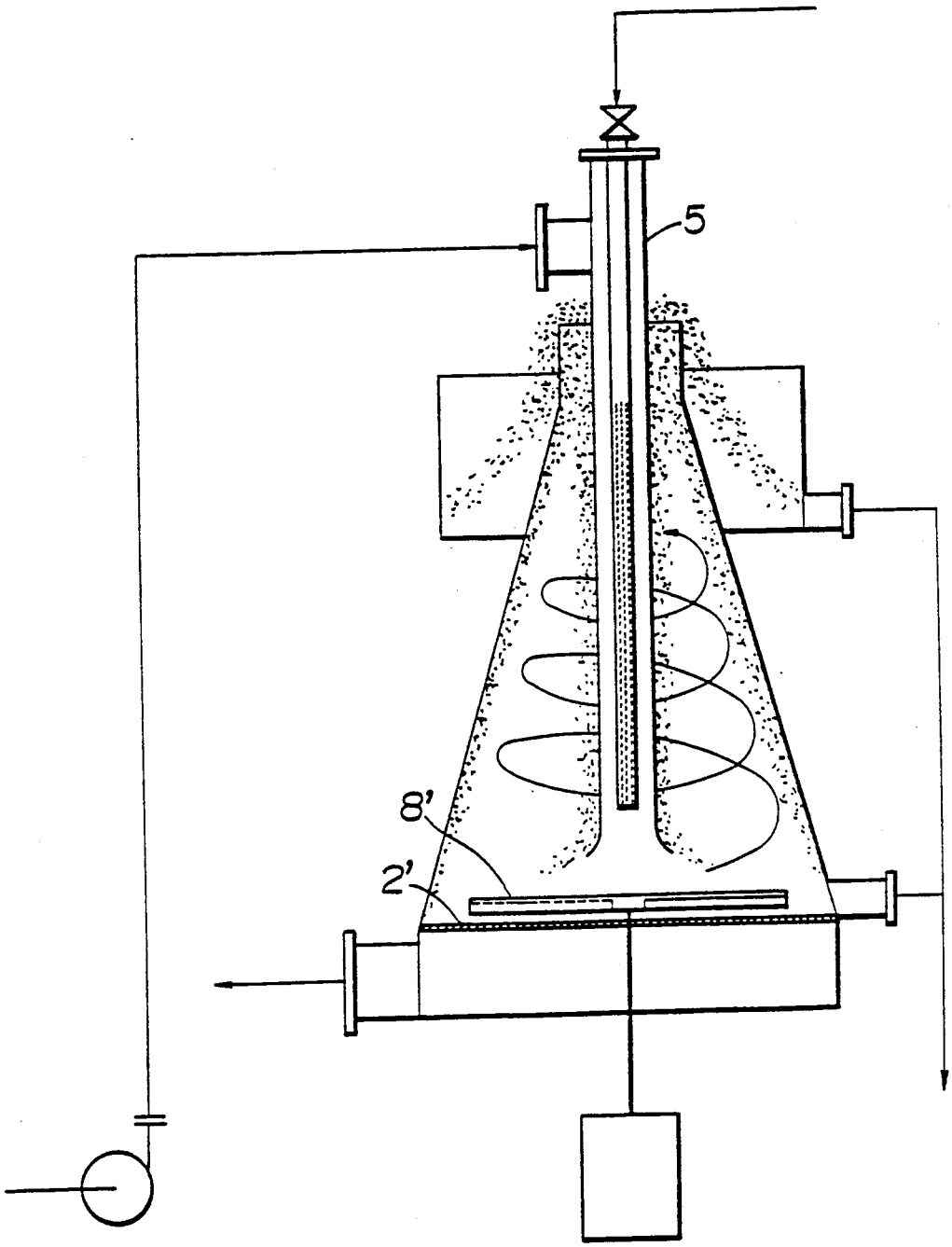
FIG. 3 is a schematic vertical sectional view of a known paper material refining apparatus.

The drum-type screen plate 2 can be vertically disposed in the tank 1, so that it can have a greater surface area as compared with the flat screen plate 2' of the known apparatus shown in FIG. 3.

The secondary chamber 4 is provided with a discharge opening 15 through which the paper material introduced through the drum-type screen plate 2 is forwarded to a next step of the process.

A material supply pipe 6 for supplying a paper material, an air supply pipe 7 for supplying air, and a drum-type rotor 8 for rotating the paper material are disposed in the primary chamber 3.

The material supply pipe 6 is disposed in an upper portion of the space inside the tank 1, while the drum-type rotor 8 is disposed in a lower portion of the space inside the tank 1. The drum-type rotor 8 has a top plate 81, the height of which is the greatest at the center and progressively decreases towards the peripheral end.

An overflow port 9 for foreign matters coming up through the primary chamber 3 is provided on a small-diameter end of the tank 1. A foreign matter receiving tray 10 is provided around the overflow port 9 so as to receive foreign matters overflowing through the overflow port 9. The foreign matter receiving tray 10 is provided with a discharge port 11, through which the foreign matters are delivered to a collecting device which is not shown.

A discharge port 12 is provided in a bottom portion of the primary chamber 3. The discharge port 12 is normally closed but is opened when a predetermined quantity of foreign matters, which have been struck by the top plate 81 of the drum-type rotor 8 and thrown outwardly, has been accumulated on the bottom of the primary chamber 3, so as to allow these foreign matters to be discharged.

The drum-type rotor 8 is disposed such that its peripheral surface opposes the drum-type screen plate 2. This drum-type rotor 8 enables the paper material to be uniformly distributed and passed through the entire area of the screen plate. This should be contrasted to the conventional apparatus shown in FIG. 3 in which the rate of passage of the paper material is greater at the peripheral region than at the central region so that contaminants are accumulated in the central portion of the screen plate where the rate of passage of the screen plate is small. The drum-type rotor 8 has a shaft 13 extending to the exterior of the primary chamber. The shaft 13 is drivingly connected to a motor 14 so that the drum-type rotor 8 is rotatingly driven by the motor 14.

A plurality of step-like projections 82 are formed on the peripheral surface of the drum-type rotor 8, preferably at a constant pitch. The drum-type rotor 8 is disposed such that its peripheral surface opposes the drum-type screen plate 2, while the top plate 81 faces the opening end of the material supply pipe 6.

The step-like projections 82 provided on the peripheral surface of the drum-type rotor 8 serve to thrust the paper material progressively toward the drum-type screen 2, with minimal pulsation. This should be contrasted to the known apparatus shown in FIG. 3 in which pulsation tends to occur during discharging of the paper material due to periodic passage of blades of the impeller 8'.

The drum-type rotor 8 vigorously stirs the material and air bubbles supplied onto the top plate 81 and crushes the air bubbles to mix them into the material, while separating the foreign matters such that the foreign matters of comparatively small mass are accumulated on the central region while foreign matters having comparatively large masses are accumulated on the peripheral region. The drum-type rotor 8 also imparts a spiral flow to the material in the primary chamber 3 by the action of the projections 82.

The material supply pipe 6 is introduced into the primary chamber 3 through the overflow port 9 and extends downward through the center of the primary chamber 3 so as to locate its lower end opening at a position where it opposes the top plate 81 of the drum-type rotor 8. A material supply port 61 is provided at the material supply pipe 6 at an upper portion thereof.

Numeral 7 denotes an air supply pipe inserted into the material supply pipe 6 so as to extend alongthe center of the latter. Air is introduced into the tank 1 through the air supply pipe 7 by means of a pump (not shown). A multiplicity of air holes 71 are formed in the wall of the air supply pipe 7 so as to attain a greater air distribution effect, whereby the air bubbles are efficiently distributed and dispersed in the material.

As a result of rotation of the drum-shaped rotor 8, the material is rotated so that light and heavy foreign matters are separated so as to be accumulated on the central region and peripheral region of the top plate 81, respectively.

For instance, light foreign matters such as ink is raised and separated by air supplied through the air supply pipe 7, while heavy foreign matters such as sand particles, metals or the like are struck out by the top plate 81 of the drum-type rotor 8, whereby refined paper material is obtained through the drum-type screen plate 2.

The light foreign matters such as ink overflow through the overflow port 9 and are collected by the foreign matter receiving tray 10 and the discharge port 11, while heavy foreign matters such as sand particles and metals contained in the material are discharged through the discharge port 12.

The paper material refining apparatus of the present invention, having the structural and operational features described hereinbefore, offers the following advantages.

In the paper material refining apparatus of the present invention,the space inside the tank is divided by a drum-type screen plate into a primary chamber and a secondary chamber. The material supply pipe for supplying the paper material and the drum-type rotor for rotating the material are disposed in the primary chamber, such that the peripheral surface of the drum type rotor opposes the drum-type screen plate, while the top plate of the rotor is positioned to oppose the open end of the material supply pipe. Consequently, the material supplied through the material supply pipe impinges upon the top plate of the drum-type rotor, and the foreign matters contained in the material is radially outwardly displaced by the centrifugal force, whereby the troubles encountered with the conventional apparatus such as jamming of foreign matters such as metal pieces between the screen plate and the impeller and consequent damaging of the screen plate and the impeller can be advantageously avoided.

In another aspect of the invention, the space inside the tank is divided by a drum-type screen plate into a primary chamber and a secondary chamber,and the material supply pipe for supplying the paper material and the drum-shaped rotor for rotating the material are disposed in the primary chamber, wherein step-like projections are formed on the outer peripheral surface of the drum-type rotor and the drum-type rotor is disposed such that its peripheral surface opposes the drum-type screen plate, with the top plate thereof facing the open end of the material supply pipe. Therefore, the projections formed on the peripheral surface of the drum-type rotor substantially uniformly act on the paper material so as to develop a substantially uniform discharge pressure on the paper material, thus preventing generation of pulsation which is inevitably generated in the conventional apparatus.

What is claimed is:

1. A paper material refining apparatus, comprising:
a tank having upper and lower portions,
a drum-type screen plate vertically situated at the lower portion of the tank, said screen plate dividing the tank into a primary chamber and a secondary chamber outside the screen plate,
a drum-type rotor vertically situated at the lower portion of the tank and arranged to be rotated along a vertical axis thereof, said rotor having a top plate and a side peripheral surface facing against the screen plate,
a material supply pipe for supplying a paper making material into said primary chamber, said material supply pipe having an end located adjacent to the top plate of the rotor, and
an air supply pipe situated inside the material supply pipe, said paper making material and air, when the apparatus is actuated, being supplied to the tank while the rotor is rotated so that the paper making material hits the top plate of the rotating rotor to select and remove foreign materials in the paper making material by centrifugal force.

2. A paper material refining apparatus according to claim 1, wherein said drum-type rotor is provided with projections formed on the peripheral surface thereof.

3. A paper material refining apparatus according to claim 1, wherein said drum-type rotor is provided with step-like projections on the peripheral surface thereof.

4. A paper material refining apparatus according to claim 1, wherein said drum-type rotor is provided with step-like projections formed at a substantially constant interval on the peripheral surface thereof.

5. A paper material refining apparatus according to claim 1, wherein said top plate is formed such that the height is greatest at a center of the top plate and progressively decreases towards a peripheral end of said top plate.

6. A paper material refining apparatus according to claim 1, wherein said tank further includes an overflow port at the upper portion of the tank so that light foreign materials contained in the paper making material is removed through the overflow port.

7. A paper material refining apparatus according to claim 6, wherein said air supply pipe includes a plurality of air holes so that air is mixed with the paper making material to form air bubbles, which are hit on the top plate, said light foreign material being removed together with the air bubbles.

8. A paper material refining apparatus according to claim 6, wherein said tank further includes a tray for collecting the light foreign materials passing through the overflow port.

9. A paper material refining apparatus according to claim 1, wherein said tank further includes a first discharge opening to be communicated with the primary chamber for removing heavy foreign material from the tank, said first discharge opening being located above the secondary chamber, and a second discharge opening communicating with the secondary chamber for discharging the paper making material passing through the screen plate.

10. A paper material refining apparatus according to claim 1, further comprising means for rotating the rotor connected to the rotor.

* * * * *